US009190713B2

(12) United States Patent
Eom et al.

(10) Patent No.: US 9,190,713 B2
(45) Date of Patent: Nov. 17, 2015

(54) ANTENNA DEVICE FOR PORTABLE TERMINAL

(75) Inventors: Sang-Jin Eom, Gyeonggi-do (KR); Ho-Saeng Kim, Gyeonggi-do (KR); Hoon Park, Seoul (KR); Joon-Ho Byun, Gyeonggi-do (KR); Jun-Hwa Oh, Seoul (KR); Bum-Jin Cho, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 146 days.

(21) Appl. No.: 13/616,072

(22) Filed: Sep. 14, 2012

(65) Prior Publication Data

US 2013/0181871 A1 Jul. 18, 2013

(30) Foreign Application Priority Data

Jan. 18, 2012 (KR) ..... 10-2012-0005898

(51) Int. Cl.

| | |
|---|---|
| ***H01Q 1/24*** | (2006.01) |
| ***H01Q 9/42*** | (2006.01) |
| ***H01Q 13/10*** | (2006.01) |
| ***H01Q 5/385*** | (2015.01) |

(52) U.S. Cl.

CPC ..... *H01Q 1/243* (2013.01); *H01Q 5/385* (2013.01); *H01Q 9/42* (2013.01); *H01Q 13/10* (2013.01)

(58) Field of Classification Search

CPC ..... H01Q 1/243; H01Q 9/0421; H01Q 9/42; H01Q 13/10; H01Q 1/38; H01Q 13/106; H01Q 13/16; H01Q 1/42; H01Q 1/422

USPC ..... 343/702, 767, 770, 872

See application file for complete search history.

(56) References Cited

U.S. PATENT DOCUMENTS

| | | | | |
|---|---|---|---|---|
| 6,657,593 | B2 * | 12/2003 | Nagumo et al. | 343/700 MS |
| 6,876,329 | B2 * | 4/2005 | Milosavljevic | 343/700 MS |
| 7,612,725 | B2 | 11/2009 | Hill et al. | |
| 7,616,158 | B2 * | 11/2009 | Mak et al. | 343/700 MS |
| 7,764,236 | B2 * | 7/2010 | Hill et al. | 343/702 |
| 7,796,090 | B2 * | 9/2010 | Minard et al. | 343/727 |

(Continued)

FOREIGN PATENT DOCUMENTS

| | | | |
|---|---|---|---|
| KR | 10-2012-0137088 | A | 12/2012 |
| WO | 03/088414 | A1 | 10/2003 |
| WO | 2009/146282 | A1 | 12/2009 |

OTHER PUBLICATIONS

Omar et al., "Design and Measurement of Self-Matched Dual-Frequency Coplanar Waveguide-Fed-Slot Antennas", IEEE Transactions on Antennas and Propagation, vol. 55.

*Primary Examiner* — Dameon E Levi
*Assistant Examiner* — Hasan Islam
(74) *Attorney, Agent, or Firm* — Cha & Reiter, LLC.

(57) ABSTRACT

An antenna device for a portable terminal having a printed circuit board (PCB) is disclosed. The antenna device is comprised of first and second antenna elements. The first antenna element includes at least a portion of one or more metal members disposed within the portable terminal; is electrically connected with a ground surface of the PCB; and has a slot. The second antenna element, is disposed in proximity to the slot, spaced from and electromagnetically coupled to the first antenna element. The second antenna element receives RF power from the PCB and is configured to resonate at a frequency of the RF power.

20 Claims, 9 Drawing Sheets

(56) References Cited

U.S. PATENT DOCUMENTS

| | | | | |
|---|---|---|---|---|
| 7,843,396 | B2 | 11/2010 | Hill et al. | |
| 8,576,561 | B2 * | 11/2013 | Myers et al. | 361/679.56 |
| 8,587,491 | B2 * | 11/2013 | Badaruzzaman et al. | 343/767 |
| 2002/0171592 | A1 * | 11/2002 | Mikkola et al. | 343/702 |
| 2008/0106478 | A1 | 5/2008 | Hill | |
| 2009/0273529 | A1 * | 11/2009 | Liu | 343/725 |
| 2010/0238072 | A1 * | 9/2010 | Ayatollahi et al. | 343/700 MS |
| 2010/0321255 | A1 | 12/2010 | Kough et al. | |
| 2011/0183721 | A1 | 7/2011 | Hill et al. | |
| 2011/0248895 | A1 * | 10/2011 | Bungo et al. | 343/702 |
| 2012/0098721 | A1 * | 4/2012 | Wong et al. | 343/749 |
| 2012/0162036 | A1 * | 6/2012 | Yanagi et al. | 343/729 |
| 2012/0268328 | A1 | 10/2012 | Kim et al. | |
| 2012/0313834 | A1 | 12/2012 | Eom et al. | |

* cited by examiner

ANTENNA DEVICE FOR PORTABLE TERMINAL

CLAIM OF PRIORITY

This application claims the benefit under 35 U.S.C. §119 (a) of a Korean patent application filed in the Korean Intellectual Property Office on Jan. 18, 2012 and assigned Serial No. 10-2012-0005898, the entire disclosure of which is hereby incorporated by reference.

BACKGROUND

1. Technical Field

The present disclosure relates generally to antennas, and more particularly, to an antenna device for a portable terminal.

2. Description of the Related Art

Portable (i.e., hand held) terminals such as mobile communication terminals (cellular phones), electronic schedulers, and personal complex terminals have become necessities of current society based on the recent technological advances in the telecommunications industry. The portable terminals have been developed into important means of information transmission, which are quickly changed.

Recently, because modern portable terminals provide a variety of multimedia functions and have become smaller and lighter to enable convenient portability, usage has risen exponentially. However, it is becoming increasingly difficult to package a plurality of components within a limited space of the portable terminal. In general, the portable terminal has an antenna for wireless communication. Recently, the antenna is embedded in the portable terminal to beautify and miniaturize the portable terminal. It is preferable that the embedded antenna meets required performance metrics to smoothly transmit and receive signals in a corresponding communication service band.

However, recently, use of a metal member for beautifying the appearance of the portable terminal or reinforcing rigidity of the portable terminal is increasing. There is a problem in that the metal member results in degradation of performance of the embedded antenna. Accordingly, there is a need for an antenna device to minimize or solve this problem.

SUMMARY

An aspect of the present invention is to solve at least the above-mentioned problems and/or disadvantages and to provide at least the advantages described below. Accordingly, an aspect of the present invention is to provide an antenna device capable of miniaturizing a portable terminal and securing antenna performance.

Another aspect of the present invention is to provide an antenna device capable of securing antenna performance using at least one or more metal members installed in a portable terminal.

Another aspect of the present invention is to provide an antenna device for resonating using a slot part which is formed in at least one or more metal members installed in a portable terminal or is formed by combination of the metal members.

In accordance with an aspect of the present invention, an antenna device for a portable terminal having a printed circuit board (PCB) is provided. The antenna device is comprised of first and second antenna elements. The first antenna element includes at least a portion of one or more metal members disposed within the portable terminal; is electrically connected with a ground surface of the PCB; and has a slot. The second antenna element, is disposed in proximity to the slot, spaced from and electromagnetically coupled to the first antenna element. The second antenna element receives RF power from the PCB and is configured to resonate at a frequency of the RF power.

BRIEF DESCRIPTION OF THE DRAWINGS

The above and other aspects, features and advantages of certain exemplary embodiments of the present invention will be more apparent from the following detailed description taken in conjunction with the accompanying drawings, in which:

FIG. 7 illustrates

DETAILED DESCRIPTION OF EXEMPLARY EMBODIMENTS

Exemplary embodiments of the present invention will be described herein below with reference to the accompanying drawings. In the following description, well-known functions or constructions are not described in detail since they would obscure the invention in unnecessary detail. Also, terms used herein should be understood in the context of the description of the exemplary embodiments Terms used may vary depending on user or operator intent and usage.

The use of certain words and phrases used throughout this patent document should be understood as follows: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; the words "may" and "can" denote at least optional features, elements, functions, etc., for embodiments disclosed herein. If definitions for certain words and phrases are provided throughout this patent document, those of ordinary skill in the art should understand that in many, if not most instances, such definitions apply to prior, as well as future uses of such defined words and phrases.

The present invention relates to an antenna device for securing antenna performance using one or more metal members installed in a portable terminal.

Embodiments described hereinafter relate to an antenna device capable of securing antenna performance using one or more metal members installed for a corresponding purpose (e.g., for decoration) in a portable terminal. Embodiments enable a metal member installed in a portable terminal to enhance antenna performance rather than degrading antenna performance as in prior art designs. An antenna device according to one embodiment of the present invention may resonate with a slot which is formed in one or more metal members installed in a portable terminal or is formed by a combination of at least two of such metal members.

Figure 1:
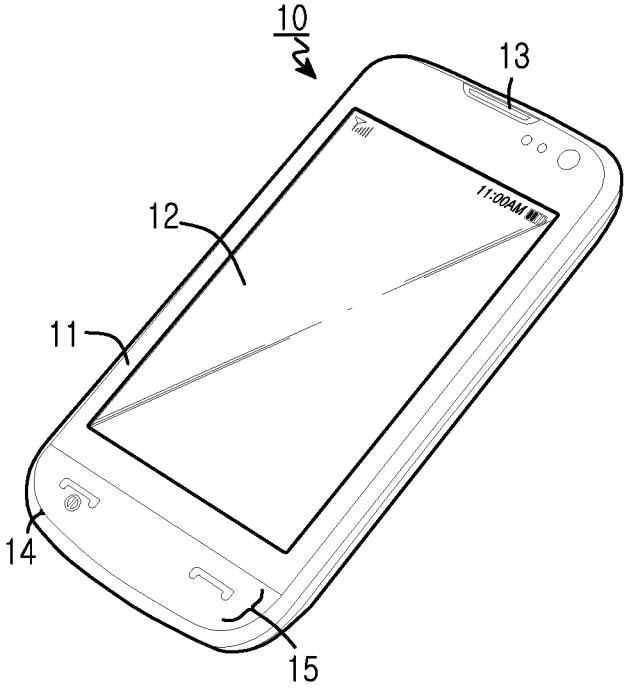
FIG. 1 is a perspective view of a portable terminal according to one embodiment of the present invention.

FIG. 1 is a perspective view of a portable terminal according to one embodiment of the present invention.

Here, the portable terminal is an example of an electronic device. Examples of a portable, i.e., hand held, electronic device include mobile phones, cellular phones and any portable device including a communication function.

Referring to FIG. 1, the portable terminal denoted by 10 includes a case frame 11 for forming the appearance of the portable terminal 10 and components, described later, installed in the case frame 11. The portable terminal 10 includes a display 12 for outputting images, a speaker 13 for outputting sounds, a microphone 14 for receiving sounds, and a button 15. In addition, the portable terminal 10 may include a touch screen. Portable terminal 10 includes a PCB (not shown) upon which electronic components of terminal 10 are mounted.

Portable terminal 10 includes an antenna device for wireless communication, embodiments of which are described hereafter. The antenna device according to an embodiment is comprised of first and second antenna elements. The first antenna element includes at least a portion of one or more metal members disposed within the portable terminal. In one example, the one or more metal members is just a metal ground surface of the PCB.

The first antenna element is electrically connected with the ground surface of the PCB. The first antenna element also has a slot. The second antenna element is disposed in proximity to the slot, and is spaced from and electromagnetically coupled to the first antenna element. The second antenna element receives RF power from an RF signal source mounted on the PCB, and is configured to resonate at a frequency of the RF power.

The metal member may be a metal plate for reinforcing the PCB, a display unit, etc., a metal structure for supporting a battery, a case frame for beautifying the appearance of the portable terminal 10, etc.

The second antenna element has a length sufficient to resonate at the RF frequency transmitted or received by the portable terminal. The first antenna element resonates by having sufficient length at the RF frequency and being electromagnetically coupled to the second antenna element. That is, the second antenna element is a parasitic element, and has current induced on the surface thereof by means of the electromagnetic coupling to the first antenna element.

The slot may have a variety of shapes. For example, the slot may be L-shaped, a circle, a polygon, an elbow shape, etc. In addition, the slot may be filled with a dielectric or a magnetic material to improve radiation performance. The second antenna element may be a monopole antenna type or a loop antenna type or another suitable type.

Figure 2:
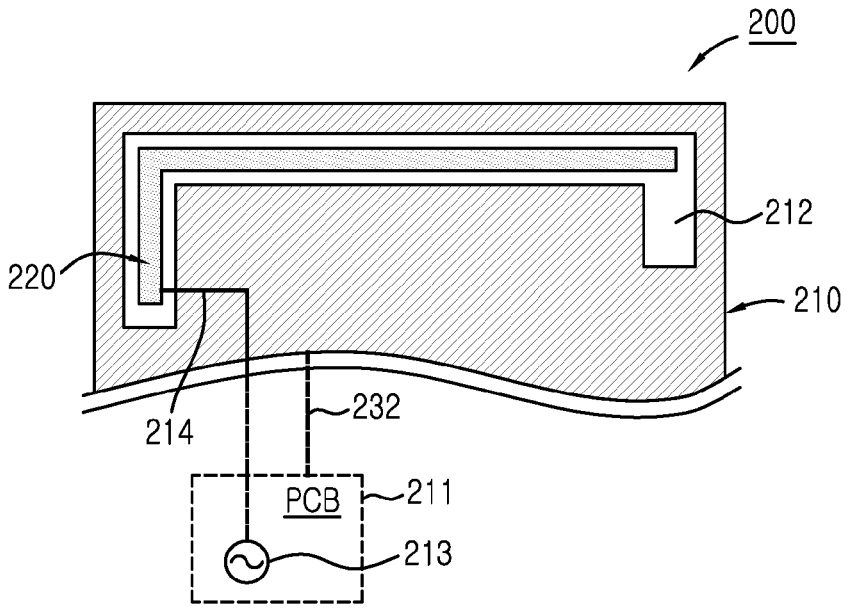
FIG. 2 illustrates a plan view/schematic diagram of an antenna device according to one embodiment of the present invention.

FIG. 2 illustrates a structure of an antenna device according to one embodiment of the present invention. The antenna device denoted by 200 according to one embodiment of the present invention includes a first antenna element 210 having a slot 212, and a second antenna element 220 spaced from the first antenna element 210 and which is positioned within the slot 212 in this embodiment. A printed circuit board (PCB) 211 which may be the main PCB of portable device 10, is RF connected to the second antenna element 220 via a feed connector means 214, and thereby transmits RF power to the second antenna element 220 during a transmit mode. During a receive mode, the second antenna element 220 provides received RF power to a receiver (not shown) mounted on PCB 211. The second antenna element 220 is of a sufficient length to resonate at the frequency of the RF power received from an RF signal source 213 of the PCB 211.

The RF frequency on transmit may be the same or nearly the same as the frequency of the RF signal in the receive mode. Further, operation of antenna device 200 is preferable over a frequency band, and the length of the second antenna element 200 and slot 212 may be designed to achieve optimum resonance at the center of the band. Further, transmit and receive modes may occur simultaneously, and the transmit frequency band need not be the same as the receive frequency band, such that antenna performance parameters may be slightly different on transmit than on receive. (Note that if antenna device 220 is used only for receiving, connection to the RF signal source 313 would not be necessary.)

The metal surface of the first antenna element 210 surrounding the slot 212 of the first antenna element 210 is electromagnetically coupled with the second antenna element 220, whereby surface current is induced in the first antenna element 210. The slot is of sufficient length and shape to cause a resonance which produces radiation by antenna element 210 due to the induced surface current. Thus, first antenna element 210 is driven as a parasitic radiation element. The slot 212 may have a thin and long groove shape. The second antenna element 220 may have a shape in which it is positioned along a groove of the slot 212. The electromagnetically coupled quantity may be determined according to a shape and/or size of the second antenna element 220, distance in which the second antenna element 220 is spaced apart from the slot 212 edges, etc. An antenna matching according to the determined quantity can be determined.

The first antenna element 210 may have the slot 212 in a single metal member itself, as illustrated in FIG. 2. In other embodiments such as those described below, a slot may be defined by a space between a plurality of metal members. Examples of such metal members are a metal plate for reinforcing PCB 211 or a display unit, etc.; a metal structure for supporting a battery; a case frame equipped with a metal member for beautifying the appearance of the portable terminal, etc. For example, the slot 212 may be alternatively formed between a ground surface of the PCB 211 and a metal plate for supporting and reinforcing a display unit electrically connected with the PCB 211.

The PCB 211 is equipped with the RF power source 213. The second antenna element 220 and the RF power supply part 213 are electrically connected through the RF feed connector means 214. The PCB 211 is a board which mounts basic circuits and components. The components of PCB 211 set an execution environment of the portable terminal and maintain the set information. PCB 211 allows the portable terminal 10 to be safely driven and smoothly performs data input and output of all devices of the portable terminal 10.

In the embodiment of FIG. 2, the second antenna element 220 is L-shaped and the slot 212 is U-shaped. Further, the U-shape is asymmetrical, with a central portion and left and right side portions, where the left side portion (corresponding to the RF feed port end of second antenna element 220) is longer than the right side portion. As mentioned above, other suitable shapes and configurations for the second antenna element 220 and slot 212 are possible.

The first antenna element 210 may be a part of PCB 211 according to one embodiment of the present invention. This option is indicated schematically by connection path 232. In general, PCB 211 includes the ground surface for reducing a harmful element such as noise. The slot 212 may be formed as an aperture in this ground surface. In addition, the second antenna element 220 may be embodied as a monopole antenna which is electrically connected with the RF power source 213 at a feed port end thereof as shown, and which has no connection at the other end as shown in FIG. 2. In an alternative configuration (not shown), the second antenna element 220 may be operated as a loop antenna which is RF connected with the RF power source 213 at the feed port one end and is electrically connected with the ground surface of PCB 211 at the other end.

It is noted that while the second antenna element 220 is shown unsupported within the slot 212, it is actually supported by a suitable support means (not shown) to maintain desired spacing from the metallic surfaces of the first antenna element 210. In the view of FIG. 2, the support means may be beneath the second antenna element 220, or may be provided via the RF connection means 214. Alternatively, a dielectric bonding agent (also not shown) may be used to attach second antenna element 220 to first antenna element 210 at various points.

Figure 3:
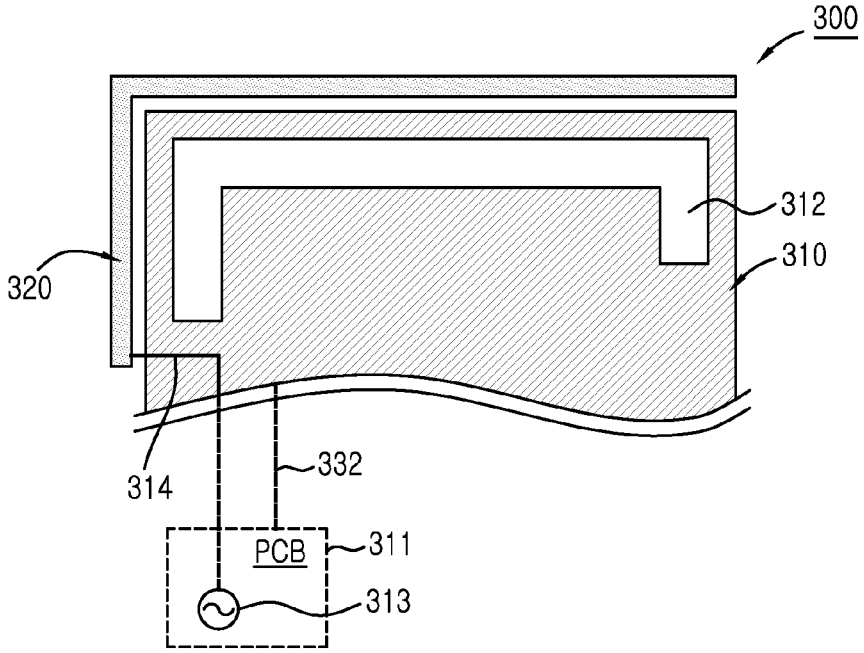
FIG. 3 illustrates a plan view/schematic diagram of an antenna device according to another embodiment of the present invention.

FIG. 3 illustrates a structure of an antenna device, 300, according to another embodiment of the present invention. This embodiment differs from the embodiment of FIG. 2 in that the second antenna element is located outside the slot of the first antenna element, instead of inside the slot.

The antenna device 300 includes a first antenna element 310 having a slot 312, a second antenna element 320 which is positioned out of the slot 312, and a PCB 311 which is RF connected with the second antenna element 320. The second antenna element 320 receives RF power from an RF power source 313 and resonates at a frequency of the RF power. The slot 312 of the first antenna element 310 is electromagnetically coupled with the second antenna element 320 and resonates due to such coupling. The second antenna element 320 is spaced apart from the first antenna element 310 and, in this embodiment, has an L-shape configuration, which bends around the outside of the first antenna element 310 in proximity to the slot 312. The second antenna element 320 is not limited to the L-shape. In the particular example of FIG. 3, the slot 312 is in the shape of an asymmetrical U, with a longer left side in proximity to an RF feed port 314 feeding an end of the second antenna element 320. Other shapes for the slot 312 are also possible. Second antenna element 320 is embodied as a monopole, and suitable support means (not shown) is provided in order to maintain desired spacing from the first antenna element 310 edges. The length of second antenna element 320 is selected to achieve resonance over a desired frequency band or bands on transmit and/or receive.

Other elements and characteristics of antenna device 300 are the same as corresponding elements of antenna device 200 of FIG. 2, or of antenna device 300 of FIG. 3; thus a redundant discussion thereof is omitted.

Figure 4:
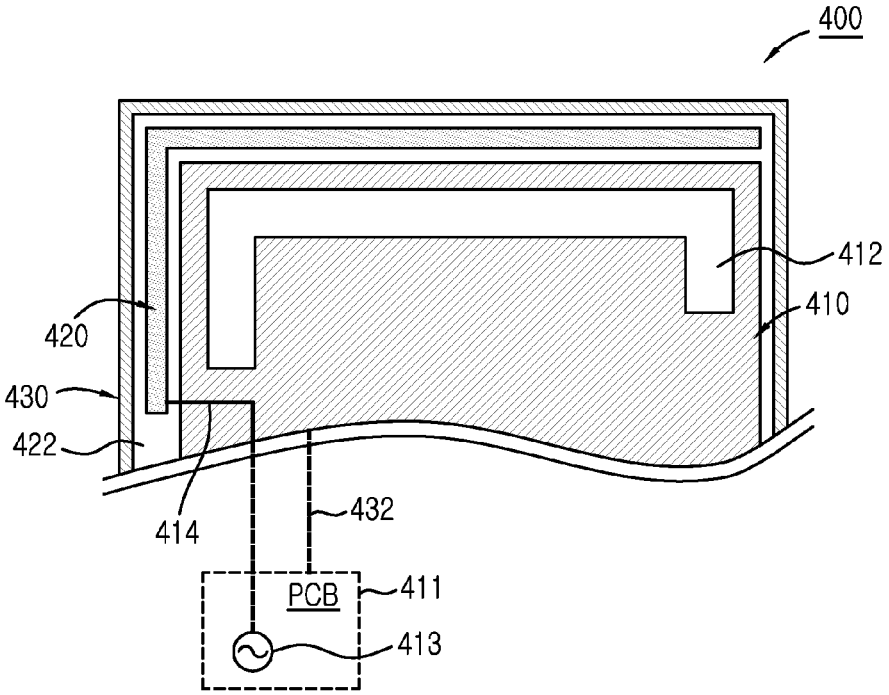
FIG. 4 illustrates a plan view/schematic diagram of an antenna device according to still another embodiment of the present invention.

FIG. 4 illustrates a structure of an antenna device, 400, according to another embodiment of the present invention. The antenna device denoted by 400 includes a first antenna element 410 having a slot 412, a second antenna element 420 which is positioned outside of the slot 412, and a PCB 411 for transmitting and receiving an RF signal to and from the second antenna element 420. The second antenna element 420 receives power from an RF power source 413, and resonates within a frequency band of the RF power. The slot 412 of the first antenna element 410 is electromagnetically coupled with the second antenna element 420 and thereby resonates.

Particularly, the antenna device 400 further includes a metallic external member 430 which surrounds the first antenna element 410 and the second antenna element 420 and insulates them from each other. The second antenna element 420 is interposed between the first antenna element 410 and the metallic external member 430 and has a shape in which it is positioned along a groove of another slot 422 formed between the edges of first antenna element 410 and the external member 430.

Other features and characteristics of antenna device 400 are the same as corresponding features of antenna device 200 of FIG. 2, thus a redundant discussion thereof is omitted.

Figure 5:
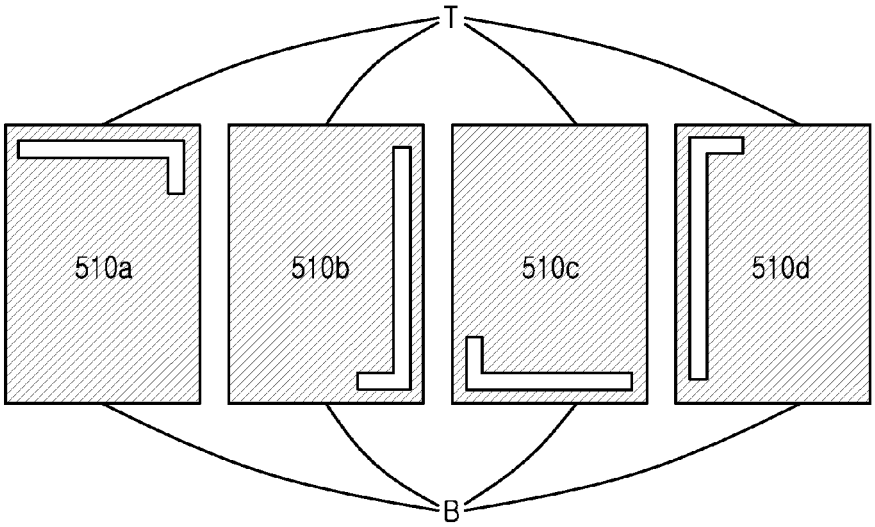
FIG. 5 illustrates a variety of positions in which a slot can be located within an antenna device and portable terminal of the present invention.

FIG. 5 illustrates a variety of positions in which a slot can be located within an antenna device and portable terminal of the present invention. As shown in FIG. 5, a slot which is formed in one metal member installed in a portable terminal or by combination of a plurality of metal members installed in the portable terminal may be formed in an upper part, a lower part, and a side part of the portable terminal. Particularly, it is preferable that the slot part is formed in a position where resonance a hand of a user, which holds the portable terminal, does not jam resonance of the slot.

In the illustrated examples, each of first antenna elements 510*a*, 510*b*, 510*c* and 510*b* has an orientation corresponding to that of the portable terminal, with a top side T and a bottom side B. The top side T is located at the top portion of the portable terminal 10 including the speaker 13 (see FIG. 1), and the bottom portion B is located at the bottom portion of the portable terminal housing the microphone 14. As shown, the slots can be located substantially along either the left, right, top or bottom sides of the generally rectangular portable terminal.

Figure 6A:
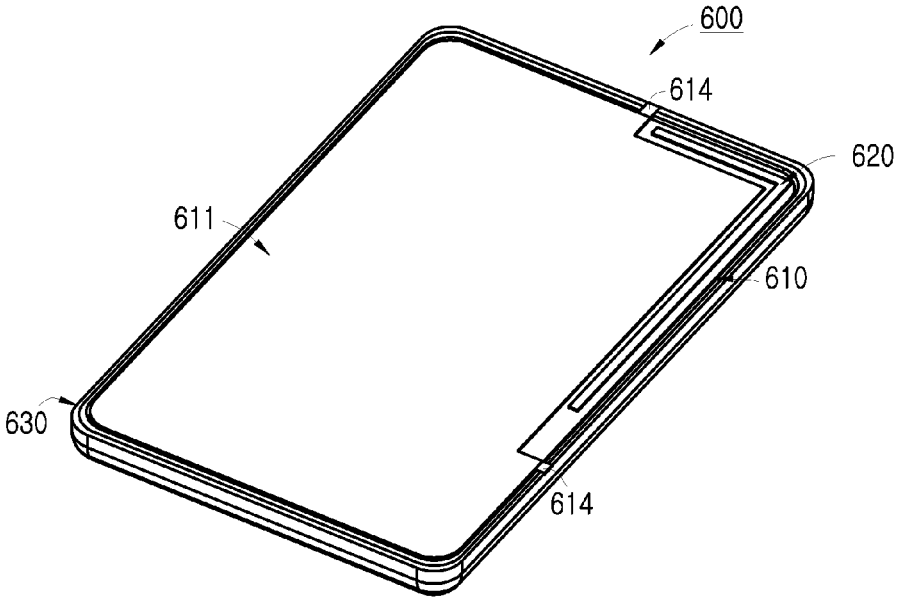
FIG. 6A and FIG. 6B illustrate a planar structure of an antenna device according to one embodiment of the present invention.
Figure 6B:
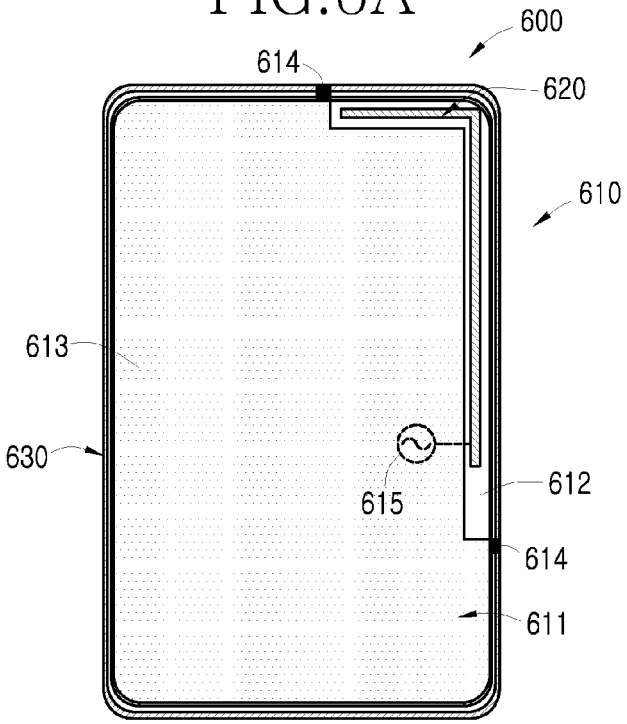

FIG. 6 illustrates a structure of an antenna device, 600, according to an embodiment of the present invention. A perspective view is shown in view (a); a plan view is illustrated in view (b). The antenna device denoted by 600 includes a metallic case frame 630 that forms part of the appearance of a portable terminal, and a PCB 611 which has a ground surface 613 that also serves as the metal surface of the first antenna element 610. This ground surface 613 is electrically connected to the metallic case frame 630 and includes a slot 612, a second antenna element 620 which is positioned in the slot 612, and the PCB 611 for transmitting and receiving an RF signal to and from the second antenna element 620.

The metallic case frame 630 and a ground surface 613 of PCB 611 together define the slot 612 therebetween. They are electrically connected through connector means 614, e.g., a plurality of spaced apart connectors.

The PCB 611 is equipped with an RF power supply 615. The second antenna element 620 is RF-connected with the power supply 615 to receive RF power therefrom. The second antenna element 610 resonates within a frequency band of the received RF power. In addition, the first antenna element 610 is electromagnetically coupled with the second antenna element 620 through the slot 612 and resonates due to the currents induced thereby. The slot part 612 have a thin and long groove shapes. The second antenna element 620 may have a shape which is positioned along a groove of the slot 612.

The second antenna element 620 may be mounted on the PCB 611, e.g., formed as a metal strip that runs along a dielectric surface of the PCB 111. However, the second antenna element 620 may alternatively be provided as an element that is separate from PCB 611.

The metallic case frame 630 can be electrically connected with not only the ground surface 613 of the main board 611 but also a metal plate for reinforcing a display unit and/or a metal structure (e.g., a battery cover) for supporting a battery. The slot 612 in this embodiment is formed between a portion of the inside surface of case frame 630, and an L shaped edge portion of ground surface 613, where the L-shaped edge is exposed due to an L-shaped cut-out along the perimeter of ground surface 613. Thus one side of the slot 612 abuts metal of ground surface 613 and the other side abuts metal of case frame 630.

The PCB 611 is a board which mounts basic circuits and components. PCB 611 includes electronics for setting an execution environment of the portable terminal and maintaining the set information. PCB 611 allows the portable terminal to be safely driven and smoothly performs data input and output of all devices of the portable terminal 10.

Figure 7A:
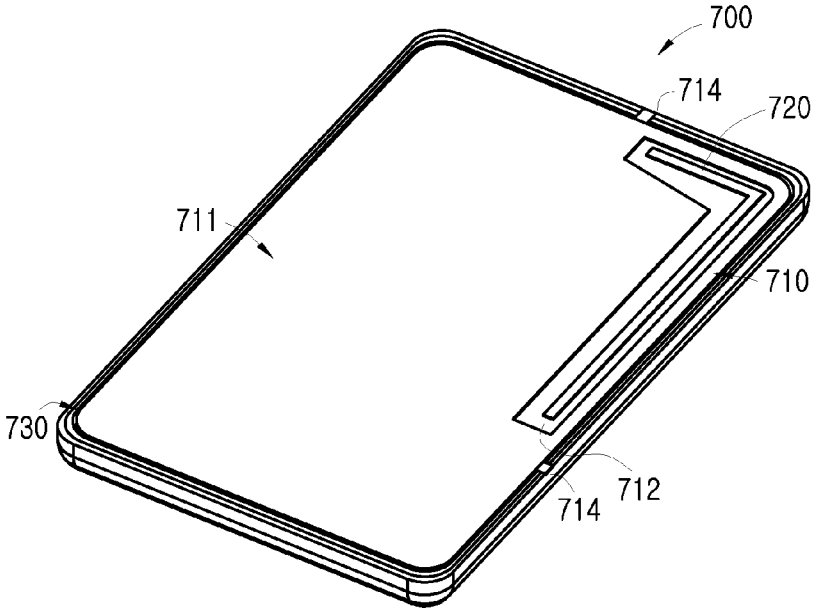
FIG. 7A and FIG. 7B illustrate a further planar structure of an antenna device according to one embodiment of the present invention.
Figure 7B:
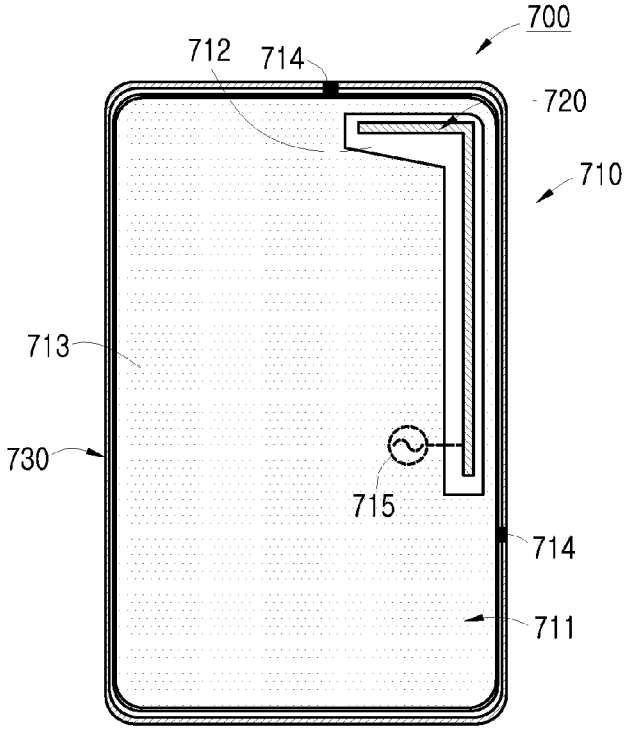

FIG. 7 illustrates a structure of an antenna device, 700, according to still another embodiment of the present invention. View (a) depicts a perspective view and view (b) is a plan view. The antenna device denoted by 700 includes a metallic case frame 730 that forms part of the appearance of a portable terminal, a PCB 711 having a ground surface 713 that is cut out to form a slot 712 entirely therein, and thereby form a first antenna element 710 comprised of the portion of the metal surface surrounding the slot 712. A second antenna element 720 which is positioned within the slot 712, and the PCB 711 supplies RF power to the second antenna element 720.

The metallic case frame 730 and a ground surface 713 of the main board 711 are electrically connected through a plurality of spaced apart connector means 714.

The PCB 711 is equipped with an RF power supply 715 which can be part of an RF communication unit (not shown) for modulating transmit signals and demodulating receive signals. The second antenna element 720 is RF-connected with the RF power supply 715. The second antenna element 720 receives RF power from the RF power supply 715 and resonates within a frequency band of the RF power. In addition, the slot 712 is electromagnetically coupled with the second antenna element 720 and resonates. Both the second antenna element 720 and the slot 712 can be L-shaped as shown. As illustrated, the slot can have a long side connecting at a right angle to a short side to form an L-shape, where the short side is tapered with a wider width at an end portion thereof.

The second antenna element 720 may be mounted on the PCB 711, or it may alternatively be provided separate from PCB.

Figure 8A:
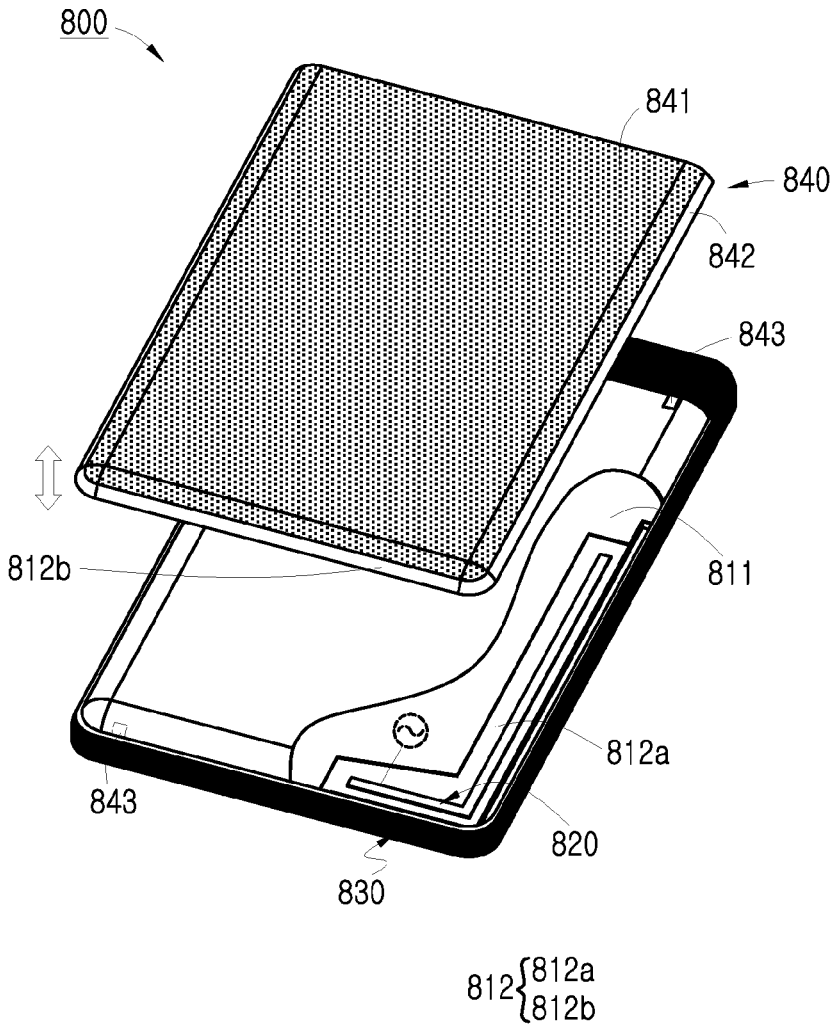
FIG. 8A illustrates a further planar structure of an antenna device according to one embodiment of the present invention.
Figure 8B:
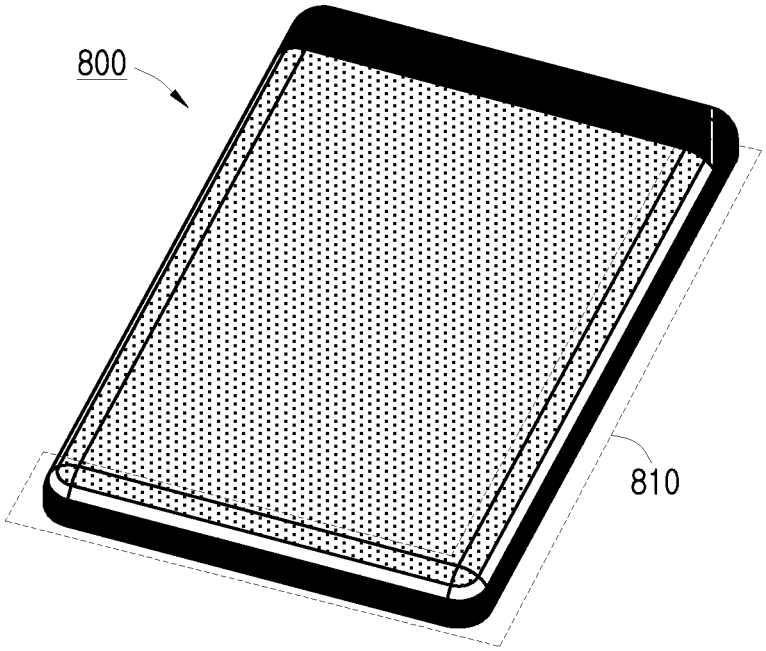
FIG. 8B illustrates a further planar structure of an antenna device according to one embodiment of the present invention.

FIGS. 8A and 8B illustrate a structure of an antenna device, 800, according to an embodiment of the present invention. The antenna device denoted by 800 includes a metallic case frame 830 for forming the appearance of a portable terminal, and a battery cover 840, a part of which is considered to form a portion of a first antenna element 810. That is, at least a portion of a metal surface 841 of the battery cover 840 acts as a portion of the first antenna element 810. A second portion of first antenna element 810 is a portion of the metallic case frame 830. The battery cover 840 is electrically coupled with the metallic case frame 830. A slot 812 consisting of slot components 812*a* and 812*b* is defined between a cut-out of a ground surface of a PCB 811, the battery cover 840 and the case frame 830. A second antenna element 820 is electromagnetically coupled to the first antenna element 810 via the slot 812 and resonates. PCB 811 transmits and receives RF signals to and from the second antenna element 820.

The battery cover 840 is detachably mounted on the metallic case frame 830. When the battery cover 840 is combined with the metallic case frame 830, it is electrically connected with the metallic case frame 830 through a plurality of connector means 843 spaced apart. In addition, the battery cover 840 includes the metal part 841 and a nonmetal part 842. When the battery cover 840 and the metallic case frame 830 are combined, the nonmetal part 842 forms a portion of the slot 812. That is, the slot 812 is formed as a combination of a slot 812*a* cut out of the ground surface of PCB 811 and a slot 812*b* which is a portion of surface 842 overlaying the slot 812*b*.

The second antenna element 820 receives RF power from the main board 811 and then resonates. The slot 812 is electromagnetically coupled with the second antenna element 820 and resonates due to the coupling.

Accordingly, in some embodiments of the present invention, two or more metal members can be combined with each other and form a slot therebetween, which enables resonance and thus antenna radiation to be achieved.

In addition, antenna devices according to embodiments of the present invention may implement resonance of a multiband and a broadband. The antenna device may be applied to a portable terminal for a triple band or a quad-band.

In conclusion, an antenna device according to the present invention may utilize a conventional metal member, which degrades antenna performance in prior art devices, as an active element of the antenna. Thus, antenna performance is enhanced, rather than degraded, with the use of the metal member.

While the present invention has been particularly shown and described with reference to exemplary embodiments thereof, it will be understood by those skilled in the art that various changes in form and details may be made therein without departing from the spirit and scope of the present invention as defined by the appended claims.

What is claimed is:

1. An antenna device for a portable terminal having a printed circuit board (PCB), the antenna device comprising:

a first antenna element including at least a dual-use portion of one or more metal members that in addition to being a portion of the first antenna element also comprises part of a structure of the portable terminal including one or more of a portion of a metallic case frame, a metal structure for supporting a battery, a display unit, or a metal structure for reinforcing the PCB, all of which are disposed entirely within the portable terminal, and electrically connected with a ground surface of the PCB, and having a slot; and a second antenna element being substantially L-shaped and having a feed port end receiving RF power from an RF power source of the PCB, disposed entirely with the portable terminal and in proximity to the slot, spaced from and electromagnetically coupled to the first antenna element, and configured to resonate at a frequency of the RF power, wherein a length of the second antenna element and the slot are sized for optimum resonance at a center of a frequency band at which the antenna device operates, and in which the first antenna element is a parasitic element having current induced on its surface by electromagnetic coupling to the second antenna element.

2. The antenna device of claim 1, wherein slot is defined by a slotted aperture of the ground surface of the PCB.

3. The antenna device of claim 1, wherein the second antenna element is disposed within the slot.

4. The antenna device of claim 1, wherein the second antenna element is disposed outside of the slot.

5. The antenna device of claim 1, wherein the dual-use portion of one or more metal members of the first antenna element includes at least a part of the metallic case frame forms part of the appearance of the portable terminal and wherein the slot is formed between the metallic case frame and at least one another metal member of the one or more metal members.

6. The antenna device of claim 5, wherein the at least one another metal member is the ground surface of the PCB.

7. The antenna device of claim 1, wherein an appearance of the portable terminal is formed at least partially by combination of a front case frame and a substantially metallic rear case frame, the first antenna element includes at least a portion of the front case frame and at least a portion of the rear case frame, and at least a portion of the slot being formed between the front and rear case frames.

8. The antenna device of claim 7, wherein at least a part of the rear case frame comprises a battery cover which is detachably mounted to the portable terminal and includes a metallic part and a nonmetallic part, wherein when the battery cover is attached to the portable terminal, the nonmetallic part is electrically connected to the front case frame, and wherein at least a portion of the slot is defined by at least a portion of the nonmetallic part.

9. The antenna device of claim 1, wherein the portable terminal has an upper part including a speaker and a lower part including a microphone, and the slot is formed in one of the upper part and the lower part.

10. The antenna device of claim 1, wherein the portable terminal is generally rectangular which has an upper part including a speaker, a lower part including a microphone, and a left side and a right side, and the slot is formed at least substantially along one of the left side and the right side.

11. The antenna device of claim 1, wherein the second antenna element is mounted on the printed circuit board.

12. The antenna device of claim 1, wherein the second antenna element is a monopole that is RF connected at a feed port end thereof to a RF signal source of the PCB.

13. The antenna device of claim 1, wherein the second antenna element is RF connected at a feed port end thereof to a RF signal source of the PCB, and is electrically connected with a ground surface of a main board at an opposite end thereof.

14. The antenna device of claim 1, wherein the second antenna element is L-shaped.

15. The antenna device of claim 1, wherein the slot is L-shaped.

16. The antenna device of claim 1, wherein both the slot and the second antenna element are L-shaped.

17. The antenna device of claim 1, wherein the slot is U-shaped and the second antenna element is L-shaped.

18. The antenna device of claim 17, wherein the U-shape is defined by a left side, a right side, and a central portion, with one of the left side and right side being longer than another of the left side and right side such that the U-shape is asymmetrical.

19. The antenna device of claim 1, wherein the slot has a long side connecting at a right angle to a short side to form an L-shape, wherein the short side is tapered with a wider width at an end portion thereof.

20. A portable electronic device comprising:

a printed circuit board (PCB); and an antenna device comprising first and second antenna elements;

wherein the first antenna element includes at least a dual-use portion of one or more metal members that in addition to being a portion of the first antenna element also comprises part of a structure of the portable electronic device including one or more of a case frame, a metal structure for supporting a battery, a display unit, or a metal structure for reinforcing the PCB, all of which are disposed entirely within the portable electronic device, and electrically connected with a ground surface of the PCB, and having a slot; and wherein the second antenna element, which is substantially L-shaped and having a feed port end receiving RF power from an RF power source of the PCB, is disposed entirely within the portable electronic device in proximity to the slot, spaced from and electromagnetically coupled to the first antenna element, receives RF power from the PCB and is configured to resonate at a frequency of the RF power, and wherein a length of the second antenna element and the slot are sized for optimum resonance at a center of a frequency band at which the antenna device operates and in which the first antenna element is a parasitic element having current induced on its surface by electromagnetic coupling to the second antenna element.

* * * * *